US010731113B2

(12) United States Patent
Burgess et al.

(10) Patent No.: US 10,731,113 B2
(45) **Date of Patent: *Aug. 4, 2020**

(54) FABRIC TREATMENT COMPOSITION

(71) Applicant: Conopco, Inc., Englewood Cliffs, NJ (US)

(72) Inventors: Karl Burgess, Wirral (GB); Martin Charles Crossman, Eastham (GB); Peter Graham, Wirral (GB); Jonathan Osler, Wirral (GB); Hugh Rieley, Wirral (GB); Shaun Charles Walsh, Cheadle (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/389,463

(22) Filed: Apr. 19, 2019

(65) Prior Publication Data

US 2019/0241840 A1 Aug. 8, 2019

Related U.S. Application Data

(63) Continuation of application No. 15/526,963, filed as application No. PCT/EP2015/075994 on Nov. 6, 2015, now Pat. No. 10,266,797.

(30) Foreign Application Priority Data

Nov. 17, 2014 (EP) ..... 14193485

(51) Int. Cl.

| | |
|---|---|
| ***C11D 3/37*** | (2006.01) |
| ***C11D 3/50*** | (2006.01) |
| ***C11D 3/22*** | (2006.01) |
| ***C11D 3/00*** | (2006.01) |

(52) U.S. Cl.

CPC ..... *C11D 3/50* (2013.01); *C11D 3/0021* (2013.01); *C11D 3/0036* (2013.01); *C11D 3/222* (2013.01); *C11D 3/227* (2013.01); *C11D 3/373* (2013.01); *C11D 3/3707* (2013.01); *C11D 3/505* (2013.01)

(58) Field of Classification Search

CPC ... C11D 11/0017; C11D 3/001; C11D 3/3707; C11D 3/50; C11D 3/505

See application file for complete search history.

(56) References Cited

U.S. PATENT DOCUMENTS

| | | | |
|---|---|---|---|
| 7,067,499 B2 | 6/2006 | Erazo-Majewicz et al. | |
| 7,871,976 B1 | 1/2011 | Aouad | |
| 10,266,797 B2 * | 4/2019 | Burgess | C11D 3/227 |
| 2007/0105739 A1 | 5/2007 | Wahl et al. | |
| 2009/0042766 A1 | 2/2009 | Mayer et al. | |
| 2011/0082066 A1 | 4/2011 | Wrubbel | |
| 2013/0267454 A1 | 10/2013 | Aouad | |

FOREIGN PATENT DOCUMENTS

| | | |
|---|---|---|
| CN | 1665843 | 9/2005 |
| CN | 1914306 | 2/2007 |
| DE | 102006034051 | 1/2008 |
| EP | 1561803 | 8/2005 |
| WO | WO9804772 | 2/1998 |
| WO | WO03095497 | 11/2003 |
| WO | WO2005090538 | 9/2005 |
| WO | WO2006132872 | 12/2006 |
| WO | WO2008009521 | 1/2008 |
| WO | WO2014079621 | 5/2014 |
| WO | WO2014099879 | 6/2014 |

OTHER PUBLICATIONS

Notice of Opposition in EP15790968.0 (EP3221438) by Henkel.; Oct. 1, 2019.

Notice of Opposition in EP15790968.0 (EP3221438) by PG.; Oct. 2, 2019.

Unilever; Experimental Report in Application No. PCTEP2015075996; Experimental Report in Application No. PCTEP2015075996; dated Sep. 6, 2019; pp. 1-3.

Izunobi et al.; Poly,er Molecular Weight Analysis by 1H NMR Spectroscopy; Journal of Chemical Education; 2011; pp. 1098-1104; vol. 88.

Search Report & Written Opinion in PCTEP2015075994; dated Jan. 25, 2016.

Search Report and Written Opinion in EP14193485; dated May 15, 2015.

Search Report & Written Opinion in PCTEP2015075996; dated Jan. 25, 2016.

Written Opinion 2 in PCTEP2015075996; dated Oct. 7, 2016.

IPRP2 in PCTEP2015075996; dated Feb. 17, 2017.

Search Report and Written Opinion in EP14193487; dated May 11, 2015.

Dong Yongchun; Chemistry of Textile Auxiliaries, edited by Dong Yongchun, Shanghai: Donghua University Press, Dec. 2009, pp. 197 and 201.; Chemistry of Textile Auxiliaries, edited by Dong Yongchun, Shanghai: Donghua University Press, Dec. 2009, pp. 197 and 201.; Dec. 2009; pp. 197 and 201; Shanghai: Donghua University Press.

* cited by examiner

*Primary Examiner* — John R Hardee

(74) *Attorney, Agent, or Firm* — Greenberg Traurig, LLP

(57) ABSTRACT

The invention relates to a fabric treatment composition comprising: a) from 50 to 95 wt. % of polyethylene glycol; b) from 0.1 to 15 wt. % of perfume; c) from 0.1 to 2.5 wt. % of cationic polymer; and, d) from 0.1 to 5 wt. % of silicone.

12 Claims, No Drawings

FABRIC TREATMENT COMPOSITION

This is a continuation of U.S. patent application Ser. No. 15/526,963, now U.S. Pat. No. 10,266,797, filed May 15, 2017.

FIELD OF THE INVENTION

The invention relates to a fabric treatment composition including a perfume that displays improved perfume intensity.

BACKGROUND OF THE INVENTION

Perfume is a useful ingredient in fabric treatment compositions. It may be provided to the fabric during laundering, for example via a main wash detergent composition; a rinse added composition, or it may be provided via a laundry adjunct composition.

SUMMARY OF THE INVENTION

There is a problem that for delivery of perfume via a laundry adjunct composition, the perfume fragrance intensity performance could be improved.

It is an object of the invention to improve the fragrance intensity performance during the laundry process.

We have now found that if the perfume containing laundry adjunct composition includes a cationic polymer and a silicone, then the fragrance intensity is improved.

The invention therefore provides in a first aspect of the invention, a fabric treatment composition comprising:— a) from 50 to 95 wt. % of polyethylene glycol;
b) from 0.1 to 15 wt. % of perfume;
c) from 0.1 to 2.5 wt. % of cationic polymer; and,
d) from 0.1 to 5 wt. % of silicone.

Preferably the polyethylene glycol is present at a level of from 55 to 95 wt. %, more preferably from 60 to 90 wt. %. Preferably the polyethylene glycol has a molecular weight of from 2,000 to 20,000, more preferably from 3,000 to 12,000, most preferably from 6,000 to 10,000.

Optionally there is a secondary carrier other than polyethylene glycol. The secondary carrier may be present at a level of from 5 to 45 wt. %, preferably from 5 to 40 wt. %, more preferably from 7.5 to 35 wt. %. If present, then preferably the secondary carrier is starch. If present, then preferably the starch is present at a level of from 5 to 45 wt. %, more preferably from 5 to 40 wt. %, most preferably from 7.5 to 35 wt. %, for example 7.5 to 30 wt. % or even 7.5 to 27.5 wt. %.

Preferably the perfume is present at a level of from 1 to 12 wt. %, preferably from 1.5 to 10 wt. %. Preferably the perfume comprises free perfume oil and perfume encapsulates.

Preferably the cationic polymer is present at a level of from 0.1 to 2 wt. %, more preferably from 0.1 to 1.5 wt. %. Preferably the cationic polymer is a cationic polysaccharide polymer, more preferably a cationic cellulose polymer or a cationic guar polymer, most preferably a cationic cellulose polymer.

Preferably the silicone is present at a level of from 0.2 to 5 wt. %, more preferably from 0.5 to 4 wt. %. Preferably the silicone is selected from: PDMS; silicone polyethers; quaternary, cationic or aminosilicones; and, anionic silicones such as silicones that incorporate a carboxylic, sulphate, sulphonic, phosphate and/or phosphonate functionality. Preferably the silicone is an anionic silicone, preferably a carboxyl functionalised silicone.

Preferably the fabric treatment composition comprises:— a) from 60 to 90 wt. % of polyethylene glycol having a molecular weight of from 3,000 to 12,000;
b) from 0.1 to 15 wt. % of perfume;
c) from 0.1 to 2 wt. % of a cationic polysaccharide polymer, preferably a cationic polysaccharide polymer; and,
d) from 0.2 to 4 wt. % of an anionic silicone, preferably a carboxy functionalised silicone.

Preferably the composition is in the form of a pastille. Preferably the pastille has a shape that is circular, spherical, oval, or lozenge shape. More preferably the shape is circular with a flat base. Preferably each pastille has a mass of from 0.05 mg to 2 g.

Preferably the composition further comprises one or more of the following ingredients: shading dye, enzyme, antiredeposition polymer, dye transfer inhibiting polymer, soil release polymer, sequestrant, and/or fluorescent agent.

DETAILED DESCRIPTION OF THE INVENTION

Polyethylene Glycol (PEG)

The fabric treatment composition comprises from 50 to 95 wt. % of polyethylene glycol. A preferred level of PEG is from 55 to 95 wt. %, more preferably from 60 to 90 wt. %.

PEG is the polymer of ethylene oxide. The PEG polymer can be made in a variety of different molecular weights. Suitable molecular weight ranges are from 2,000 to 20,000, more preferably from 3,000 to 12,000, most preferably from 6,000 to 10,000.

Other Carrier Materials

The composition may additionally comprise, in addition to the polyethylene glycol, a secondary carrier material.

The secondary carrier may be present at a level of from 5 to 45 wt. %, preferably from 5 to 40 wt. %, more preferably from 7.5 to 35 wt. %. If present, then preferably the secondary carrier is starch. If present, then preferably the starch is present at a level of from 5 to 45 wt. %, more preferably from 5 to 40 wt. %, most preferably from 7.5 to 35 wt. %, for example 7.5 to 30 wt. % or even 7.5 to 27.5 wt. %.

Starch is a carbohydrate. The starch may be modified or refined. A preferred type of starch is tapioca starch.

Perfume

The composition comprises from 0.1 to 15 wt. % of perfume. Preferably the composition comprises from 1 to 12 wt. % of perfume, more preferably from 1.5 to 10 wt. % of perfume Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

The perfume may be in the form of free perfume oil, perfume encapsulates or a mixture thereof.

Cationic Polymer

The composition comprises a cationic polymer at a level of from 0.1 to 2.5 wt. %, preferably from 0.1 to 2 wt. %, more preferably from 0.1 to 1.5 wt. %.

This term refers to polymers having an overall positive charge.

Preferably the cationic polymer is selected from the group consisting of: cationic polysaccharide polymers, and cationic non-saccharide polymers having cationic protonated amine or quaternary ammonium functionalities that are homo or copolymers derived from monomers containing an amino or quaternary nitrogen functional group polymerised from at least one of the following monomer classes: acrylate, methacrylate, acrylamide, methacrylamide; allyls (including diallyl and methallyl); ethylene imine; and/or vinyl monomer classes, and mixtures thereof.

Most preferably the cationic polymer is a cationic polysaccharide polymer.

More preferably the cationic polysaccharide polymer is a cationic guar or cationic cellulose polymer. Most preferably the cationic polymer is a cationic cellulose polymer, for example, quaternised hydroxy ethyl cellulose.

The composition may include a single cationic polymer or a mixture of cationic polymers from the same or different classes, i.e. the composition may contain a cationic polysaccharide polymer and a cationic non-polysaccharide polymer. Suitable commercial cationic non-polysaccharide polymers are ones preferably but not exclusively taken from the Polyquarternium series for example Polyquat 5, 6, 7, 11, 15, 16, 28, 32, 37 and 46 which are sold commercially under the Flocare, Merquat, Salcare, Mirapol, Gafquat and Luviquat tradenames. Cationic non-polysaccharides can be used without conforming to the Polyquaterium nomenclature.

A preferred class of cationic polysaccharide polymers suitable for this invention are those that have a polysaccharide backbone modified to incorporate a quaternary ammonium salt. Preferably the quaternary ammonium salt is linked to the polysaccharide backbone by a hydroxyethyl or hydroxypropyl group. Preferably the charged nitrogen of the quaternary ammonium salt has one or more alkyl group substituents.

Preferred cationic polysaccharide-based polymers have a guar based, or cellulosic based backbone. Cellulose based cationic polymers are most preferred.

Guar is a galactomannan having a β-1,4 linked mannose backbone with branchpoints to α-1,6 linked galactose units.

Suitable cationic guar gum derivatives, such as guar hydroxypropyltrimonium chloride, specific examples of which include the Jaguar series commercially available from Rhone-Poulenc Incorporated and the N-Hance series commercially available from Aqualon Division of Hercules, Inc.

An example of a preferred guar based cationic polymer is guar 2-hydroxy-3-(trimethylammonium) propyl ether salt.

Cellulose is a polysaccharide with glucose as its monomer, specifically it is a straight chain polymer of D-glucopyranose units linked via β-1,4 glycosidic bonds and is a linear, non-branched polymer.

Example cationic cellulose polymers are salts of hydroxyethyl cellulose reacted with trimethyl ammonium substituted epoxide, referred to in the field under the International Nomenclature for Cosmetic Ingredients as Polyquatemium 10 and is commercially available from The Dow Chemical Company, marketed as the UCARE LR and JR series of polymers. Other polymers are marketed under the SoftCAT tradename from The Dow Chemical Company. Other suitable types of cationic celluloses include the polymeric quaternary ammonium salts of hydroxyethyl cellulose reacted with lauryl dimethyl ammonium-substituted epoxide referred to in the field under the International Nomenclature for Cosmetic Ingredients as Polyquatemium 24.

Typical examples of preferred cationic cellulosic polymers include cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; cellulose 2-hydroxyethyl 2-hydroxy 3-(trimethyl ammonio) propyl ether salt, polyquaternium-4, polyquaternium-10, polyquaternium-24 and polyquaternium-67 or mixtures thereof.

More preferably the cationic cellulosic polymer is a quaternised hydroxy ether cellulose cationic polymer. These are commonly known as polyquaternium-10. Suitable commercial cationic cellulosic polymer products for use according to the present invention are marketed by The Dow Chemical Corporation under the trade name UCARE.

The counterion of the cationic polymer is freely chosen from the halides: chloride, bromide, and iodide; or from hydroxide, phosphate, sulphate, hydrosulphate, ethyl sulphate, methyl sulphate, formate, and acetate.

Many of the aforementioned cationic polymers can be synthesised in, and are commercially available in, a number of different molecular weights. Preferably the molecular weight of the cationic polymer is from 10,000 to 2,000,000 Daltons, more preferably from 100,000 to 1,000,000 Daltons, even more preferably from 250,000 to 1,000,000 Daltons.

Silicone

The composition comprises fabric softening silicone at a level of from 0.1 to 5 wt. %, preferably from 0.2 to 5 wt. %, more preferably from 0.5 to 4 wt. %.

The silicone is preferably selected from: PDMS; silicone polyether, quaternary, cationic or aminosilicones; and, anionic silicones such as silicones that incorporate a carboxylic, sulphate, sulphonic, phosphate and/or phosphonate functionality.

A preferred silicone is an aminosilicone or an anionic silicone. The most preferred is an anionic silicone.

The amino silicone may be present in the form of the amine or the cation.

Examples of amino silicones are amino functional silicones with a nitrogen content of between 0.1 and 0.8%.

Preferably the amino silicone has a molecular weight of from 1,000 to 100,000, more preferably from 2,000 to 50,000 even more preferably from 5,000 to 50,000, Examples of anionic silicones are silicones that incorporate carboxylic, sulphate, sulphonic, phosphate and/or phosphonate functionality. Preferred anionic silicones are carboxyl functionalised silicones.

The anionic silicone may be in the form of the acid or the anion. For example for the carboxyl functionalised silicone, it may be present as a carboxylic acid or carboxylate anion.

Preferably the anionic silicone has a molecular weight of from 1,000 to 100,000, more preferably from 2,000 to 50,000 even more preferably from 5,000 to 50,000, most preferably from 10,000 to 50,000.

Preferably the anionic silicone has an anionic group content of at least 1 mol %, preferably 2 mol %.

Form of the Fabric Treatment Composition

The fabric treatment may be shaped into any suitable form. It may take the form of sheets, or preferably be formed into a pastille.

The pastille composition is melted then maintained at a temperature of 60° C.+/−10° C., then pumped onto a perforated cylinder which is perforated in the desired shape of the final product. The melt is then delivered to a chilled steel belt to rapidly cool and solidify the pastille.

The pastille can be processed into any desirable shape, including circular shapes, spheres, ovals, lozenges and the like. Preferably the shape is circular with a flat base.

A preferred mass of a pastille is from 0.05 mg to 2 g.

Further Ingredients

The laundry treatment composition may further optionally comprise one or more of the following optional ingredients, shading dye, enzyme, antiredeposition polymer, dye transfer inhibiting polymer, soil release polymer, sequestrant, and/or fluorescent agent.

Shading Dye

Shading dyes deposit to fabric during the wash or rinse step of the washing process providing a visible hue to the fabric. Shading of white garments may be done with any colour depending on consumer preference. Blue and Violet are particularly preferred shades and consequently preferred dyes or mixtures of dyes are ones that give a blue or violet shade on white fabrics. The shading dyes used are preferably blue or violet.

The shading dye chromophore is preferably selected from the group comprising: mono-azo, bis-azo, triphenylmethane, triphenodioxazine, phthalocyanin, naptholactam, azine and anthraquinone. Most preferably mono-azo, bis-azo, azine and anthraquinone.

Most preferably the dye bears at least one sulfonate group.

Preferred shading dyes are selected from direct dyes, acid dyes, hydrophobic dyes, cationic dyes and reactive dyes.

If included, the shading dye is preferably present is present in the composition in range from 0.0001 to 0.01 wt %.

Enzymes

Enzymes can also be present in the formulation. Preferred enzymes include protease, lipase, pectate lyase, amylase, cutinase, cellulase, mannanase. If present the enzymes may be stabilized with a known enzyme stabilizer for example boric acid.

Anti-Redeposition Polymers

Anti-redeposition polymers are designed to suspend or disperse soil. Typically antiredeposition polymers are ethoxylated and or propoxylated polyethylene imine materials.

Dye Transfer Inhibitors

Modern detergent compositions typically employ polymers as so-called 'dye-transfer inhibitors'. These prevent migration of dyes, especially during long soak times. Generally, such dye-transfer inhibiting agents include polyvinyl pyrrolidone polymers, polyamine N-oxide polymers, copolymers of N-vinylpyrrolidone and N-vinylimidazole, manganese pthalocyanine, peroxidases, and mixtures thereof, and are usually present at a level of from 0.01 to 10 wt. % based on total amount in the laundry composition.

Soil Release Polymers

Soil release polymers are designed to modify the surface of the fabric to facilitate the easier removal of soil. Typically soil release polymers are based on or derivatives of polyethylene glycol/vinyl acetate copolymers or polyethylene glycol terephthalate polyesters.

Fluorescent Agent

The composition may comprise a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt. %, more preferably 0.01 to 0.1 wt. %.

The invention will now be demonstrated by the following non-limiting examples.

EXAMPLES

Example 1

Test Formulation A

| Ingredient | Wt. % |
|---|---|
| Glyercol | 5.00 |
| MPG | 11.00 |
| MEA | 7.00 |
| TEA | 2.50 |
| Citric Acid | 3.0 |
| Neodol 25-7 | 4.5 |
| LAS acid | 8.5 |
| Fatty acid | 3.00 |
| SLES 3EO | 7.0 |
| Sodium Sulphite | 0.25 |
| pH adjustment | To pH 8.0 |
| Fragrance | 1.4 |
| Water | To 100 wt. % |

Pastilles

| Ingredient | Pastille Z | Pastille 1 |
|---|---|---|
| PEG 8000 | 65 | 65 |
| Starch (Tapioca starch) | Balance | Balance |
| Cationic Polymer (Ucare LR400) | — | 0.67 |
| Silicone (Carboxy functional silicone) | — | 1.67 |
| Perfume | 7 | 7 |
| Perfume Encapsulates | 2 | 2 |

The pastilles were prepared by heating the polyethylene glycol to melt to 75° C. The starch is added with stirring. The cationic polymer and silicone are then added with stirring. The melt was then allowed to cool to 60° C. at which time the fragrance and encapsulated fragrance were added with stirring. The molten mixture was fed through to a perforated rolling cylinder then dropped onto a chilled steel belt conveyor. When the melted mix falls on the cold surface a pastille will form as the melt solidifies.

Wash Experiment

Miele Machines were set to a 40° C. cotton short cycle. The water hardness that was used for this study was 26 degrees FH (3:1 Calcium:Magnesium ratio).

A 2 kg ballast load comprising of Polycotton sheeting (approx size 50×100 cm) and 15 Terry Towelling Squares (20×20 cm size) were added to the machine drum. The towelling squares are mixed in with the sheeting in a random order within the washing machine so that they are not all together.

30 g of the pastille is added to the drum followed by the mixed fabrics and finally the liquid detergent (formulation A) is added to the drum via a dosing ball, door is closed and then the machine is set to wash. Once the wash has finished the load is removed from the machine and the terry towelling squares are separated out and line dried on racks. The remainder of the load is tumble dried. Once the terry towelling squares are dry then the whole process is repeated again to achieve 4 washes with drying.

At the conclusion of the $4^{th}$ cycle the towels were left in a controlled conditioning environment (20° C., 65% RH) for 1 week. They are then are passed on for sensory evaluation.

Sensory Protocol—Perfume Intensity

A panel scoring sensory technique was used for the perfume intensity trial. Cloths (each labelled with a 3 digit code) were presented to the participants. Test samples were presented in a randomised order. The participant was asked to pick up the test cloth in both hands and required to gently manipulate it close to their nose, noting how intense the perfume was then asked to score the towel between 0-100.

Fragrance Intensity

| Pastille | Panellist #1 | Panellist #2 | Panellist #3 | Panellist #4 | Panellist #5 | Totals and Mean |
|---|---|---|---|---|---|---|
| Detergent only | 12 | 18 | 13 | 0 | 30 | |
| Pastille Z | 29 | 35 | 55 | 15 | 20 | 154 |
| Pastille 1 | 70 | 43 | 70 | 10 | 30 | 223 |
| % increase or decrease between 1 and Z | +141% | +23% | +27% | −33% | +50% | +44% |

The technical effect of increased perfume fragrance intensity was seen for 4 out 5 panellists. This effect can be clearly seen when the mean % increase or decrease between 1 and Z across the 5 panellists is taken into account. The mean % increase or decrease between 1 and Z across the 5 panellists was 44% [(223−154)/154].

A further pastille was prepared in the same fashion as previously described, and has the formula:—

| Ingredient | Pastille 2 |
|---|---|
| PEG 8000 | 65 |
| Starch (Tapioca starch) | Balance |
| Cationic Polymer (Ucare LR400) | 0.67 |
| Silicone (Carboxy functional silicone) | 1.67 |
| Perfume | 7 |
| Perfume Encapsulates | — |

The invention claimed is:

1. A fabric treatment composition comprising:

a) from 50 to 95 wt. % of polyethylene glycol;
wherein the polyethylene glycol has a molecular weight of from 2,000 to 20,000, b) from 0.1 to 15 wt. % of perfume; and
wherein the perfume comprises free perfume oil and perfume encapsulates, c) from 0.1 to 5 wt. % of silicone,
wherein the silicone is PDMS, and wherein the composition is in the form of a pastille.

2. The composition of claim 1, wherein the composition further comprises 0.1 to 2.5 wt. % of cationic polymer.

3. The composition of claim 1, wherein the polyethylene glycol is present at a level of from 55 to 95 wt. %.

4. The composition of claim 1, further comprising a secondary carrier other than polyethylene glycol at a level of from 5 to 45 wt. %.

5. The composition of claim 4, wherein said secondary carrier is starch.

6. The composition of claim 1, wherein the perfume is present at a level of from 1 to 12 wt. %.

7. The composition of claim 1, wherein the cationic polymer is present at a level of from 0.1 to 2 wt. %.

8. The composition of claim 1, wherein the cationic polymer is a cationic polysaccharide polymer.

9. The composition of claim 1, wherein the silicone is present at a level of from 0.2 to 5 wt. %.

10. The composition of claim 1, wherein the pastille has a shape that is circular, spherical, oval, or lozenge shape.

11. The composition of claim 1, wherein each pastille has a mass of from 0.05 mg to 2 g.

12. The composition of claim 1, further comprising one or more of the following ingredients: shading dye, enzyme, antiredeposition polymer, dye transfer inhibiting polymer, soil release polymer, sequestrant, and/or fluorescent agent.

* * * * *